US011490186B2

(12) United States Patent
Tang et al.

(10) Patent No.: US 11,490,186 B2
(45) Date of Patent: Nov. 1, 2022

(54) EDGE PATTERNS OF MICROELECTROMECHANICAL SYSTEMS (MEMS) MICROPHONE BACKPLATE HOLES

(71) Applicants: INVENSENSE, INC., San Jose, CA (US); TDK Electronics AG, Munich (DE)

(72) Inventors: Tsung Lin Tang, Hsinchu (TW); Chia-Yu Wu, San Jose, CA (US); Chung-Hsien Lin, Hsinchu (TW); Dennis Mortensen, Munich (DE); Pirmin Rombach, Kongens Lyngby (DK)

(73) Assignees: INVENSENSE, INC., San Jose, CA (US); TDK ELECTRONICS AG, Munich (DE)

( * ) Notice: Subject to any disclaimer, the term of this patent is extended or adjusted under 35 U.S.C. 154(b) by 0 days.

(21) Appl. No.: 17/211,512

(22) Filed: Mar. 24, 2021

(65) Prior Publication Data

US 2022/0070568 A1 Mar. 3, 2022

Related U.S. Application Data

(60) Provisional application No. 63/072,646, filed on Aug. 31, 2020.

(51) Int. Cl.
*H04R 1/08* (2006.01)

(52) U.S. Cl.
CPC ..... *H04R 1/08* (2013.01); *H04R 2201/003* (2013.01)

(58) Field of Classification Search
None
See application file for complete search history.

(56) References Cited

U.S. PATENT DOCUMENTS

2007/0286438 A1 12/2007 Hirade et al.
2013/0223023 A1* 8/2013 Dehe ..... B81B 7/0029 361/752

(Continued)

FOREIGN PATENT DOCUMENTS

DE 102010035168 A1 2/2021
EP 2071871 A1 6/2009

(Continued)

OTHER PUBLICATIONS

Extended European Search Report for EP Application No. 21194006.9, dated Feb. 2, 2022, 11 pages.

(Continued)

*Primary Examiner* — Kenny H Truong
(74) *Attorney, Agent, or Firm* — Amin, Turocy & Watson, LLP

(57) ABSTRACT

Robust microelectromechanical systems (MEMS) sensors and related manufacturing techniques are described. Disclosed MEMS membranes and backplate structures facilitate manufacturing robust MEMS microphones. Exemplary MEMS membranes and backplate structures can comprise edge pattern holes having a length to width ratio greater than one and/or configured in a radial arrangement. Disclosed implementations can facilitate providing robust MEMS membranes and backplate structures, having edge pattern holes with a profile resembling at least one of an oval, an egg, an ellipse, a droplet, a cone, or a capsule or similar suitable configurations according to disclosed embodiments.

16 Claims, 13 Drawing Sheets

(56) References Cited

U.S. PATENT DOCUMENTS

| | | | | |
|---|---|---|---|---|
| 2013/0264663 | A1 | 10/2013 | Dehe et al. | |
| 2016/0195567 | A1 | 7/2016 | Tanaka | |
| 2019/0116427 | A1* | 4/2019 | Inoue | H04R 31/003 |

FOREIGN PATENT DOCUMENTS

| | | | |
|---|---|---|---|
| EP | 3114857 | B1 | 12/2017 |
| WO | 03068668 | A2 | 8/2003 |

OTHER PUBLICATIONS

Office Action for EP Application No. 21194006.9, dated Mar. 7, 2022, 2 pages.

* cited by examiner

EDGE PATTERNS OF MICROELECTROMECHANICAL SYSTEMS (MEMS) MICROPHONE BACKPLATE HOLES

PRIORITY CLAIM

This patent application is a non-provisional patent application that claims priority to U.S. Provisional Patent Application Ser. No. 63/072,646, filed Aug. 31, 2020, entitled "EDGE PATTERNS OF MICROPHONE BACKPLATE HOLES," the entirety of which is incorporated herein by reference.

TECHNICAL FIELD

The disclosed subject matter relates to microelectromechanical systems (MEMS) sensors such as MEMS microphones or acoustic and more specifically devices and methods for providing robust, high-performance MEMS membrane structures such as those found in MEMS microphones and acoustic transducers and other devices.

BACKGROUND

Conventionally, microelectromechanical systems (MEMS) microphones or acoustic transducers can be fabricated from a substrate, a backplate, and a flexible diaphragm, where the backplate, being in proximity to the flexible diaphragm, can form a variable capacitance device. In an aspect, a backplate can be perforated so that sound pressure entering the MEMS microphone package via a port can pass through the perforated backplate and deflect the diaphragm. In such conventional MEMS microphones a direct current (DC) bias voltage ($V_{bias}$) applied to the backplate (or the diaphragm) facilitates measuring sound pressure induced deflections of the flexible diaphragm as an alternating current AC voltage, thereby providing a useful signal for further processing.

In addition, conventional MEMS microphones or acoustic transducers must be able to provide high sensitivity while being able to withstand mechanical shock such as might be presented in typical devices. For instance, robustness is a very important specification for high performance microphones or acoustic transducers, especially for mobile phone applications. As an example, when a mobile phone drops to flat surface, a high pressure can applied to the microphone diaphragm membrane, which can make it to contact the backplate. This contact force can push induce large deformation and high stress to the backplate. If the MEMS microphones or acoustic transducer backplate structure is not sufficiently robust, the backplate can break when the stress is over the yield point of materials employed in the structure, which structure is typically designed as a trade-off between robustness, flexibility, sensitivity, and manufacturing process constraints.

It is thus desired to provide robust MEMS microphones or acoustic transducers and related MEMS membrane manufacturing techniques that improve upon these and other deficiencies. The above-described deficiencies of MEMS microphones are merely intended to provide an overview of some of the problems of conventional implementations, and are not intended to be exhaustive. Other problems with conventional implementations and techniques and corresponding benefits of the various non-limiting embodiments described herein may become further apparent upon review of the following description.

SUMMARY

The following presents a simplified summary of the specification to provide a basic understanding of some aspects of the specification. This summary is not an extensive overview of the specification. It is intended to neither identify key or critical elements of the specification nor delineate any scope particular to any embodiments of the specification, or any scope of the claims. Its sole purpose is to present some concepts of the specification in a simplified form as a prelude to the more detailed description that is presented later.

In various non-limiting embodiments of the disclosed subject matter, devices and methods for providing robust MEMS membranes and backplate structures, are described. For instance, non-limiting implementations provide exemplary MEMS microphones comprising edge pattern holes having a length to width ratio greater than one and/or configured in a radial arrangement, as further described herein. For instance, various non-limiting implementations can facilitate providing robust MEMS membranes and backplate structures, having edge pattern holes with a profile resembling at least one of an oval, an egg, an ellipse, a droplet, a cone, or a capsule. In further non-limiting examples, exemplary devices can comprise MEMS sensors, microphones, or acoustic transducers employing the robust MEMS membrane or backplate structures described. In various non-limiting embodiments as described herein, the disclosed subject matter facilitates methods of manufacturing of robust MEMS membranes and backplate structures.

Other non-limiting implementations of the disclosed subject matter provide exemplary systems and methods directed to these and/or other aspects described herein.

BRIEF DESCRIPTION OF THE DRAWINGS

Various non-limiting embodiments are further described with reference to the accompanying drawings in which.

DETAILED DESCRIPTION

Overview

Figure 1:
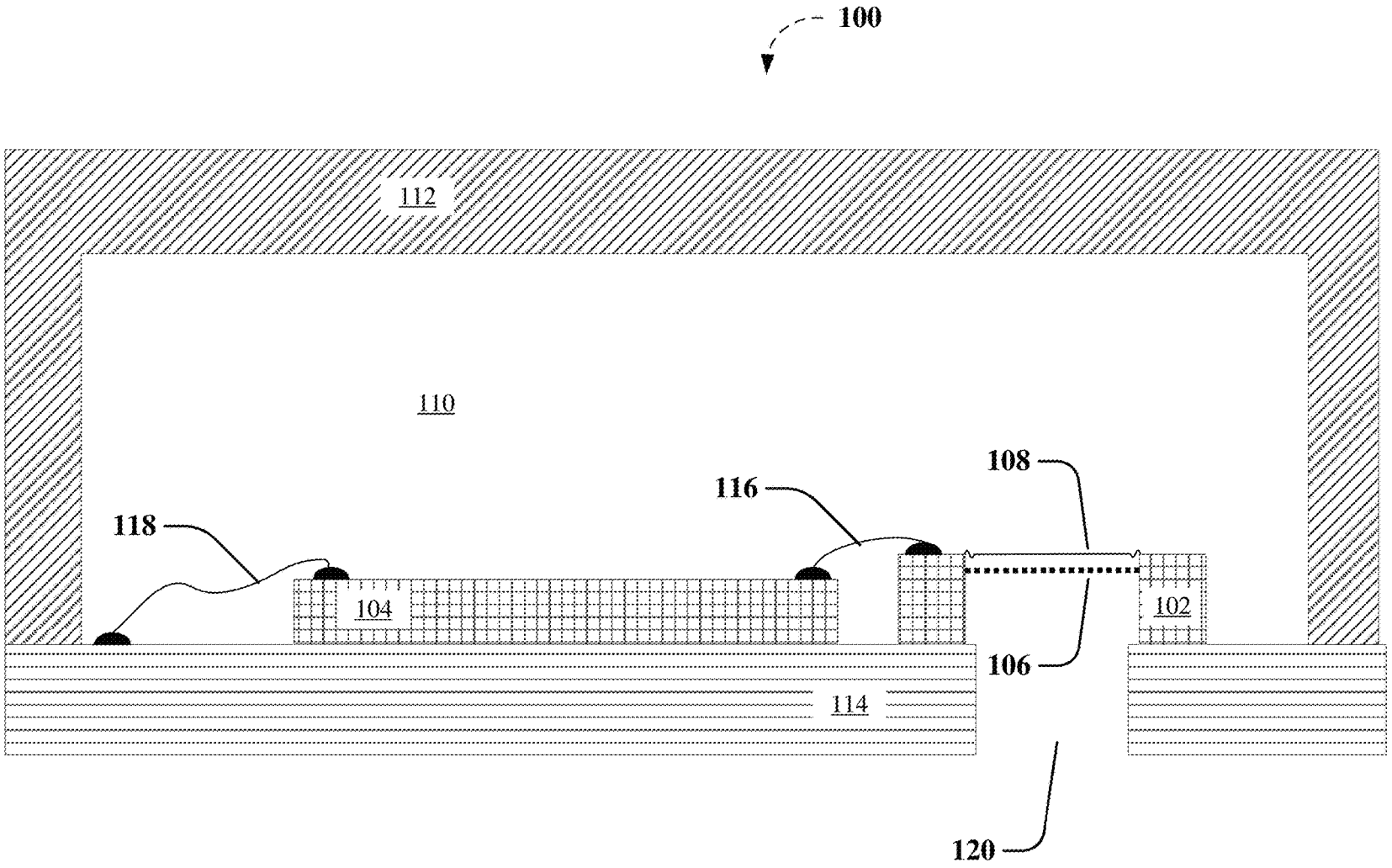
FIG. 1 depicts a non-limiting schematic cross section of a conventional MEMS acoustic sensor device or microphone suitable for incorporating various non-limiting aspects as described herein.

While a brief overview is provided, certain aspects of the disclosed subject matter are described or depicted herein for the purposes of illustration and not limitation. Thus, variations of the disclosed embodiments as suggested by the disclosed apparatuses, systems and methodologies are intended to be encompassed within the scope of the subject matter disclosed herein. For example, the various embodiments of the apparatuses, techniques and methods of the disclosed subject matter are described in the context of MEMS sensors such as MEMS microphones and acoustic transducers. However, as further detailed below, various exemplary implementations can be applied to other applications of MEMS sensors employing a MEMS membrane structure, without departing from the subject matter described herein.

As described in the background, microelectromechanical systems (MEMS) microphones or acoustic transducer can be fabricated from a substrate, a backplate, and a flexible diaphragm, where the backplate, being in proximity to the flexible diaphragm, can form a variable capacitance device. In an aspect, a backplate can be perforated so that sound pressure entering the MEMS microphone package via a port can pass through the perforated backplate and deflect the diaphragm. Such MEMS microphones or acoustic transducers must be able to provide high sensitivity while being able to withstand mechanical shock such as might be presented in typical devices. If the MEMS microphones or acoustic transducer backplate structure is not sufficiently robust, the backplate can break when the stress is over the yield point of materials employed in the structure, which structure is typically designed as a trade-off between robustness, flexibility, sensitivity, and manufacturing process constraints. Accordingly, various non-limiting embodiments described herein provide robust MEMS microphones or acoustic transducers employing robust MEMS membrane structures and related manufacturing techniques.

As used herein, microelectromechanical (MEMS) systems can refer to any of a variety of structures or devices fabricated using semiconductor-like processes and exhibiting mechanical characteristics such as the ability to move or deform. For instance, such structures or devices can interact with electrical signals. As a non-limiting example, a MEMS acoustic sensor can include a MEMS transducer and an electrical interface. In addition, MEMS structures or devices can include, but are not limited to, gyroscopes, accelerometers, magnetometers, environmental sensors, pressure sensors, acoustic sensors or microphones, and radio-frequency components.

As described above, conventional, non-MEMS microphones can comprise designs employing a capacitor structure employing two generally parallel structures, such as membranes and/or electrodes. For instance in a conventional condenser microphone, a parallel structure comprising a movable membrane and a stationary electrode can be employed, and a power source can be used to generate a bias voltage or polarizing voltage between the movable membrane and the stationary electrode. As the movable membrane (e.g., diaphragm) moves towards or away from the stationary electrode (e.g., perforated backplate) in response to sound pressure, the capacitance between the movable membrane (e.g., diaphragm) and the stationary electrode (e.g., perforated backplate) can also change, and the change can be detected by electronic circuitry, such as a preamplifier, coupled to the MEMS acoustic sensor or microphone to process the signal produced by the sound pressure.

Exemplary Embodiments

For instance, FIG. 1 depicts a non-limiting schematic cross section of an exemplary MEMS sensor device 100 (e.g., microphone or acoustic transducer 100) suitable for incorporating various non-limiting aspects as described herein. Accordingly, MEMS sensor device 100 can comprise a MEMS acoustic sensor or microphone element 102. In further exemplary embodiments, MEMS sensor device or microphone 100 can also comprise an ASIC complementary metal oxide semiconductor (CMOS) 104 chip associated with the MEMS acoustic sensor or microphone element 102. In various aspects, MEMS acoustic sensor or microphone element 102 can comprise a perforated backplate 106, supported within MEMS acoustic sensor or microphone element 102 around the edges or perimeter of the perforated backplate 106, that can act as a stationary electrode in concert with a flexible diaphragm 108 to facilitate the transduction of acoustic waves or pressure into an electrical signal that can be operatively coupled to ASIC CMOS 104. Thus, as described above, exemplary MEMS acoustic sensor or microphone element 102 can comprise a perforated backplate 106, and a flexible diaphragm 108, where the perforated backplate 106, being in proximity to the flexible diaphragm 108, can form a variable capacitance device.

While the MEMS sensor device or microphone 100 is depicted as an exemplary acoustic sensor or microphone device for the purposes of understanding various non-limiting aspects of the disclosed subject matter, it can be understood that various aspects as described herein are not limited to applications involving acoustic sensors and/or microphone devices, and, as such, may be employed in conjunction with other MEMS sensors or other contexts. For instance, various aspects as described herein can be employed in other applications involving capacitive devices or sensors, and/or devices or sensors employing MEM membrane structures as described herein.

As depicted in FIG. 1, the MEMS sensor device or microphone 100 can comprise one of the one or more back cavities 110, which can be defined by a lid or cover 112 attached to package substrate 114, according to a non-limiting aspect, as further described above. In various non-limiting aspects, one or more of MEMS acoustic sensor or microphone element 102, ASIC CMOS 104 chip, and/or lid or cover 112 can be one or more of electrically coupled and/or mechanically affixed to package substrate 114, via methods available to those skilled in the art. As non-limiting examples, MEMS acoustic sensor or microphone element 102 can be bonded to package substrate 114 and electrically coupled to ASIC CMOS 104 (e.g., via wire bond 116), and ASIC CMOS 104 can be bonded and electrically coupled (e.g., via wire bond 118) to package substrate 114. Thus, MEMS acoustic sensor or microphone element 102, in the non-limiting example of MEMS sensor device or microphone 100, is mechanically affixed to package substrate 114, and electrically or operatively coupled to the ASIC CMOS 104 chip.

Furthermore, lid or cover 112 and package substrate 114 together can comprise a package comprising MEMS sensor device or microphone 100, to which a customer printed circuit board (PCB) (not shown) having a port, an orifice, or other means of passing acoustic waves or sound pressure to MEMS acoustic sensor or microphone element 102 can be mechanically, electrically, and/or operatively coupled. For example, acoustic waves or sound pressure can be received at MEMS acoustic sensor or microphone element 102 via package substrate 114 having port 120 adapted to receive acoustic waves or sound pressure. An attached or coupled customer PCB (not shown) providing an orifice or other means of passing the acoustic waves or sound pressure facilitates receiving acoustic waves or sound pressure at MEMS acoustic sensor or microphone element 102.

As described above, in an aspect, backplate 106 can comprise a perforated backplate 106 that facilitates acoustic waves or sound pressure entering the MEMS sensor device or microphone 100 package via a port 120, which can pass through the perforated backplate 106 and deflect the flexible diaphragm 108. While exemplary MEMS sensor device or microphone 100 is described as comprising port 120 that facilitates acoustic waves or sound pressure entering the MEMS sensor device or microphone 100 package via a port 120, pass through the perforated backplate 106, and deflect the flexible diaphragm 108, it can be understood that various aspects as described herein are not limited to implementations involving MEMS sensor device or microphone 100. For instance, as described above, various aspects as described herein can be employed in implementations (not shown) where sound pressure entering the MEMS microphone package via a port can directly impinge the diaphragm opposite the backplate (not shown), e.g., via a port 120 in lid or cover 112, in addition to further variations employing MEMS membrane structures and techniques described herein.

Figure 2:
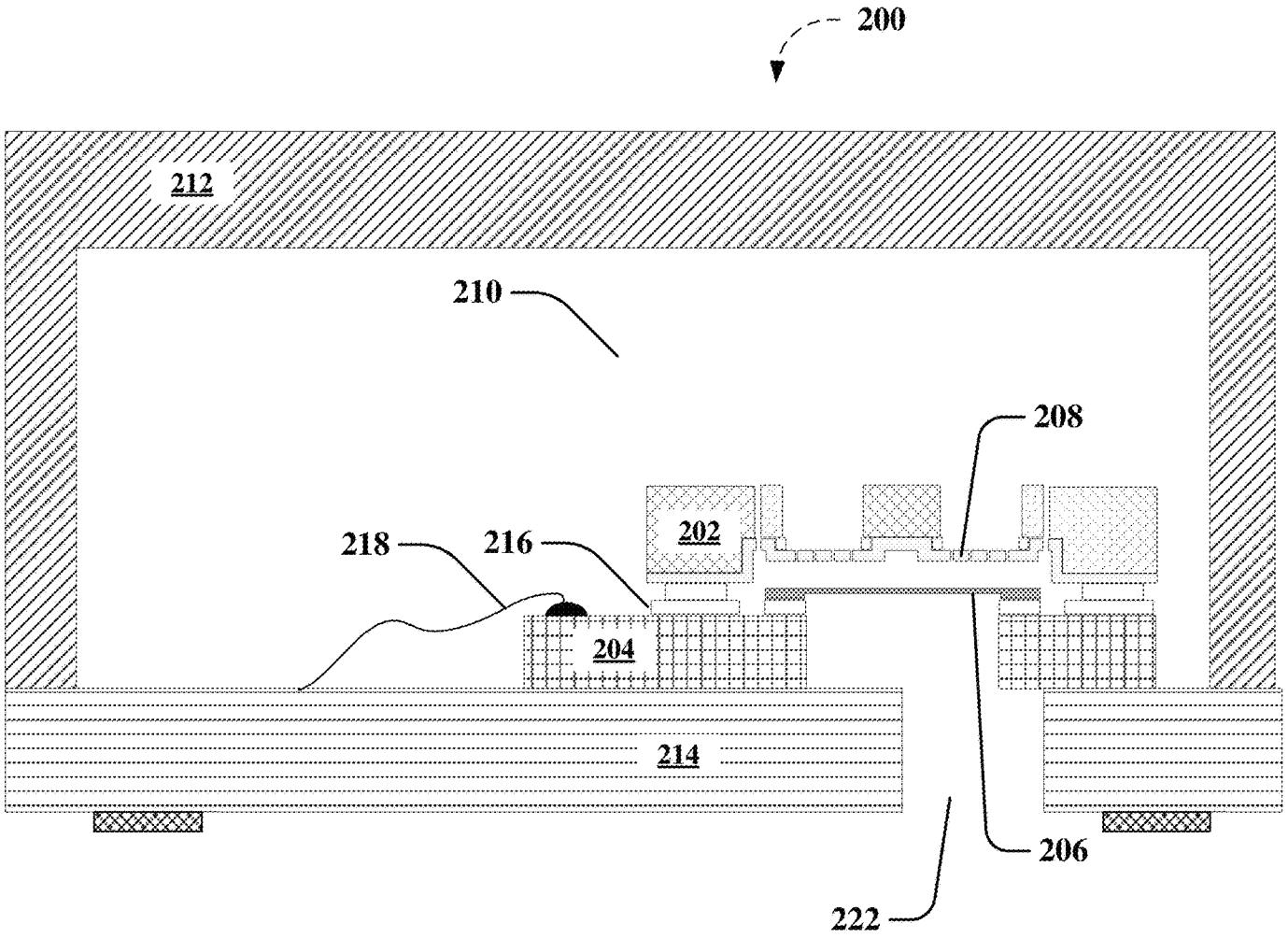
FIG. 2 depicts another non-limiting schematic cross section of a conventional device (e.g., a MEMS acoustic sensor or microphone) suitable for incorporating various non-limiting aspects as described herein.

As an example, FIG. 2 depicts another non-limiting schematic cross section of a conventional device (e.g., a MEMS acoustic sensor or microphone) suitable for incorporating various non-limiting aspects as described herein. Accordingly, FIG. 2 depicts a non-limiting schematic cross section of a device 200 (e.g., microphone or acoustic transducer 200) comprising engineered structures, according to further non-limiting aspects as described herein. Accordingly, device 200 can comprise a MEMS acoustic sensor or microphone element 202, such as a MEMS acoustic sensor or microphone element comprising or associated with components and engineered structures, as further described above regarding FIG. 1, for example. In further exemplary embodiments, device 200 can also comprise an application-specific integrated circuit (ASIC) complementary metal oxide semiconductor (CMOS) chip 204 associated with the MEMS acoustic sensor or microphone element 202. In various aspects, MEMS acoustic sensor or microphone element 202 can comprise a stationary electrode (e.g., perforated backplate 206), according to particular MEMS acoustic sensor or microphone architectures that can act in concert with a movable membrane (e.g., diaphragm 208) to facilitate the transduction of acoustic waves or pressure fluctuations into an electrical signal that can be communicatively coupled to ASIC CMOS 204. In a non-limiting aspect, MEMS acoustic sensor or microphone element 202 can be associated with a back cavity 210, which can be defined by a lid or cover 212 attached to package substrate 214, according to a non-limiting aspect.

In various non-limiting aspects, one or more of MEMS acoustic sensor or microphone element 202, ASIC CMOS chip 204, and/or lid or cover 212 can be one or more of electrically coupled or mechanically affixed to package substrate 214, via methods available to those skilled in the art. As non-limiting examples, MEMS acoustic sensor or microphone element 202 can be bonded 216 and electrically coupled to ASIC CMOS chip 204, and ASIC CMOS chip 204 can be bonded and electrically coupled (e.g., wire bonded 218) to package substrate 214. Thus, MEMS acoustic sensor or microphone element 202, in the non-limiting example of device 200, is mechanically, electrically, and/or communicatively coupled to the ASIC CMOS chip 204.

Furthermore, lid or cover 212 and package substrate 214 together can comprise MEMS acoustic sensor or microphone device or package 200, to which a customer printed circuit board (PCB) (not shown) having an orifice or other means of passing acoustic waves or pressure to MEMS acoustic sensor or microphone element 202, which can be mechanically, electrically, and/or communicatively coupled (e.g., via solder 216). For example, acoustic waves can be received at MEMS acoustic sensor or microphone element 202 via package substrate 214 having port 220 adapted to receive acoustic waves or pressure. An attached or coupled customer PCB (not shown) providing an orifice or other means of passing the acoustic waves facilitates receiving acoustic waves or pressure at MEMS acoustic sensor or microphone element 202.

Figure 3:
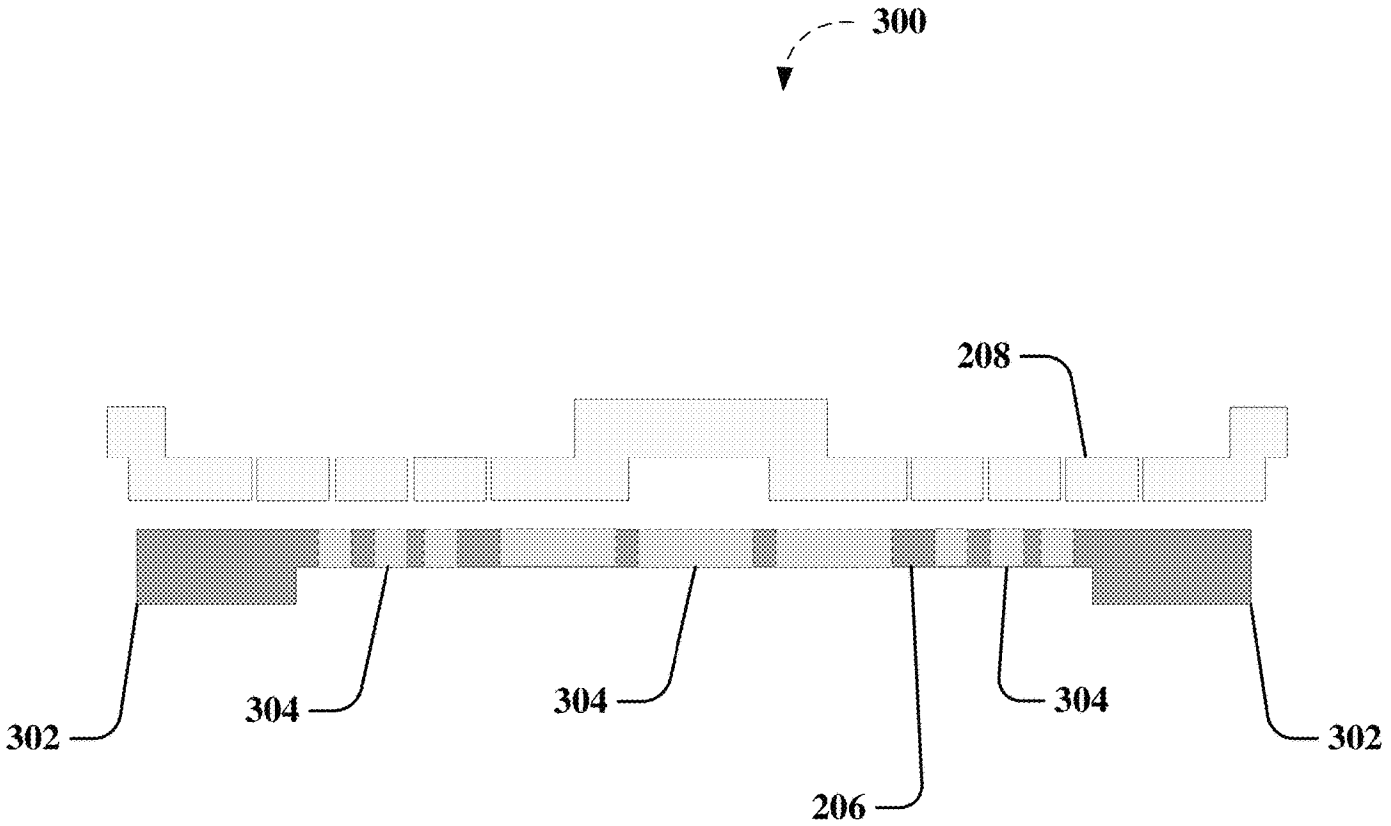
FIG. 3 depicts a conventional perforated backplate and diaphragm associated with an exemplary MEMS acoustic sensor or microphone suitable for incorporating various non-limiting aspects as described herein.

FIG. 3 depicts a schematic diagram 300 showing a side view of a conventional perforated backplate 206 and diaphragm 208 associated with an exemplary MEMS acoustic sensor or microphone (e.g., microphone or acoustic transducer 100, 200) suitable for incorporating various non-limiting aspects as described herein. As described above, MEMS microphones or acoustic transducers can be fabricated from a substrate, a backplate 206, and a flexible diaphragm 208, where the backplate 206, being in proximity to the flexible diaphragm 208, can form a variable capacitance device. In an aspect, backplate 206 can be supported at or near edges 302. As further described above, backplate 206 can comprise perforations 304 in a suitable arrangement so that sound pressure entering the MEMS microphone package via a port (not show) can pass through the perforated backplate 206 and deflect the diaphragm 208, such as described above regarding FIGS. 1-2.

The arrangement, configuration and number of perforations 304 can be selected as a trade-off between backplate or membrane flexibility, device sensitivity, and manufacturing processing constraints. However, if the MEMS microphones or acoustic transducer backplate 206 structure is not sufficiently robust, the backplate 206 can break when the stress is over the yield point of materials employed in, and the structure specifications selected for the structure, are subjected to extreme shock.

Figure 4:
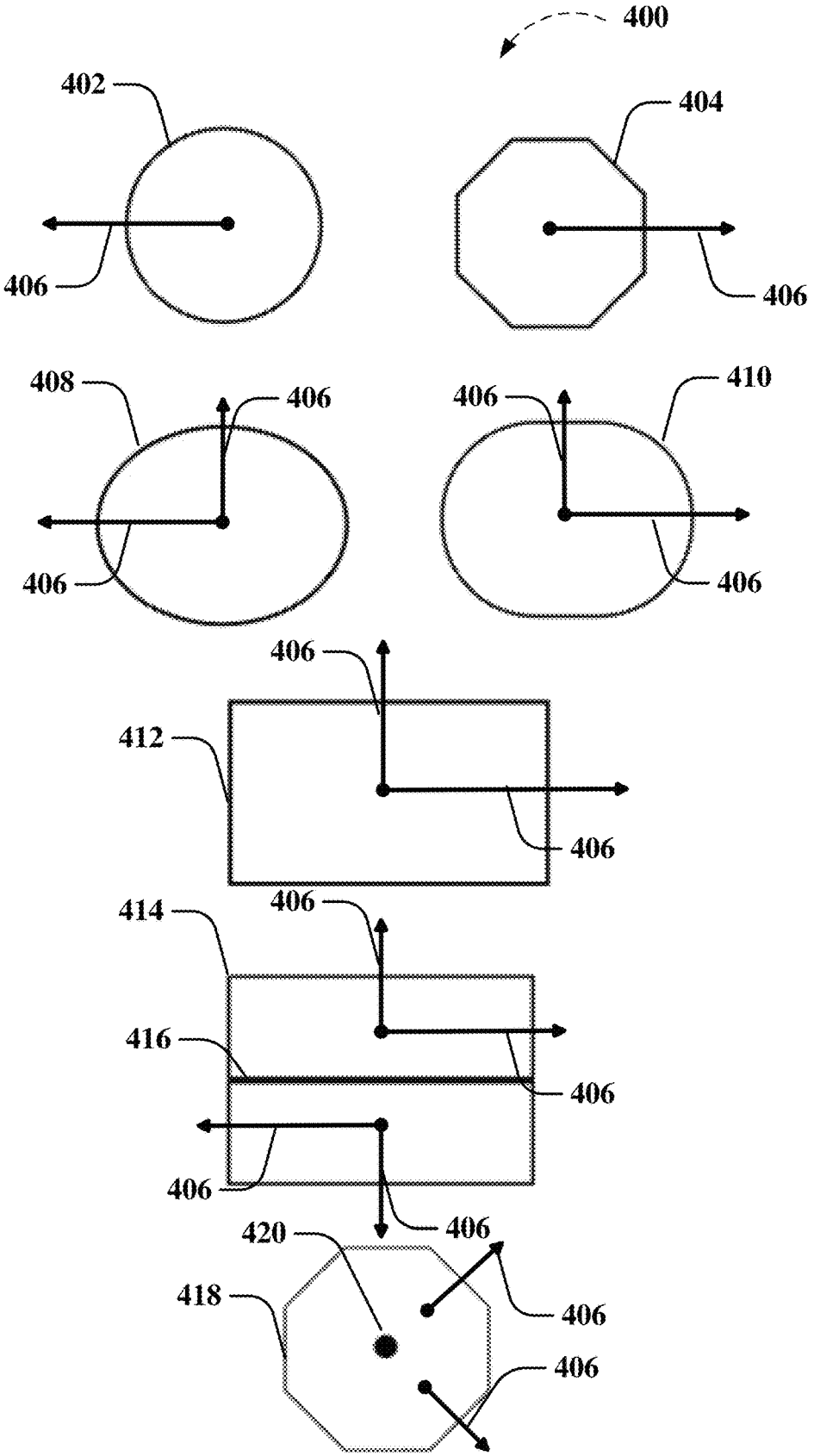
FIG. 4 depicts exemplary top views of various non-limiting configurations of a membrane such as a backplate for a MEMS acoustic sensor or microphone, suitable for incorporating various non-limiting aspects as described herein.

FIG. 4 depicts exemplary top views 400 of various non-limiting configurations of a membrane such as a backplate for a MEMS acoustic sensor or microphone (e.g., microphone or acoustic transducer 100, 200), suitable for incorporating various non-limiting aspects as described herein. Various embodiments described herein refer to arrangements, directions, or configurations in a "radial" arrangement, in a "radial" direction, or in a "radial" configuration. Thus, FIG. 4 is provided as an aid to illustration a non-limiting variety of membrane or backplate shapes suitable for incorporation of exemplary aspects described herein. For the purposes of illustration, and not limitation, the term, "membrane," is used when referring to the various shaped structures in FIG. 4. It can be understood that the various aspects described herein are not limited to the application of membranes but can be employed in various shaped structures regardless of whether the structures are membrane-like or otherwise. As a result, the term, "membrane" is used interchangeably to refer to MEMS backplates and other similarly configured MEMS structures employing the disclosed aspects. For each of the membrane or backplate shapes, the membrane or backplate shapes are understood to comprise a supported structure where the support is provided at the edges of the shapes, as described above regarding FIGS. 1-3, except where further noted below.

For instance, FIG. 4 depicts a circular membrane 402 and an octagonal membrane 404. Each of circular membrane 402 and an octagonal membrane 404 can be characterized by a radius or radial direction 406 emanating from a nominal center of the membrane shape. In the case of the circular membrane 402 the nominal center coincides with the actual center of the circle, which is a point equidistant from the edges of the circular membrane 402. Similarly for octagonal membrane 404 a nominal center coincides with an actual center of the octagonal membrane 404, which is a point equidistant from opposite, parallel sides of edges (or from opposite vertices). While membranes or backplates can be configured in other shapes, the descriptive term radial can be more problematic. For example, for even-number-sided polygons, the term, "radial," can generally be understood to correspond to that meaning as for the octagonal membrane 404. For odd-number-sided polygons, the term, "radial," can generally be understood to correspond to that for a circular membrane 402, for a circle circumscribing the polygon.

For other shapes, the term, "radial," can be even more problematic. For instance, FIG. 4 depicts an elliptical membrane 408 and a capsule-shaped membrane 410 (e.g., generally rectangular-shaped with rounded ends). For an ellipse, major and minor axes of an ellipse are diameters (e.g., lines through the center) of the ellipse. The major axis is the longest diameter and the minor axis the shortest. If they are equal in length then the ellipse is a circle. Elliptical membrane 408 can be characterized by a radius or radial direction 406 emanating from a nominal center of the membrane shape, wherein the nominal center coincides with the intersection of the major and minor axes of an ellipse.

Likewise, for a capsule-shaped membrane 410 (e.g., generally rectangular-shaped with rounded ends), major and minor axes of a capsule-shaped membrane 410 (e.g., generally rectangular-shaped with rounded ends) are diameters (e.g., lines through the center) of the capsule-shaped membrane 410 (e.g., generally rectangular-shaped with rounded ends). This intersection of the major and minor axes of a capsule-shaped membrane 410 (e.g., generally rectangular-shaped with rounded ends) can define an actual center of the capsule-shaped membrane 410 (e.g., generally rectangular-shaped with rounded ends). However, it can be understood that the term, "radial," can be better defined as emanating from the nominal center, where the nominal center can be defined as collection of points or a line segment through the actual center of the capsule-shaped membrane 410 (e.g., generally rectangular-shaped with rounded ends) along the major axis, and extending to a point intersecting with the radius of curvature of the ends of the capsule-shaped membrane 410 (e.g., generally rectangular-shaped with rounded ends). For instance, in the interior of the capsule, the term, "radial" can be understood to be in a direction roughly orthogonal to the major axis, whereas at the end of the capsule, term, "radial" can be understood to be in a direction of the radius of the curvature of the curved ends. Similar variations can be defined for capsule-shaped membrane 410 having elliptical ends, without departing from the disclosed subject matter.

FIG. 4 further depicts a rectangular membrane 412, which can be understood as comprising rounded corners or otherwise. As with the capsule-shaped membrane 410 (e.g., generally rectangular-shaped with rounded ends), the term, "radial" can generally be understood as described for capsule-shaped membranes 410 (e.g., generally rectangular-shaped with rounded ends), except that there is no radius of curvature at the ends of the rectangle (for rectangles without rounded corners), where the radius of curvature can be defined as desired (e.g., assuming radius of curvature is one-half of the minor axes or other suitable selections). In other instances of a rectangular membrane 412, such as that comprising rounded corners, a radius of curvature of the rounded corners can be used to define a "radial" direction as desired (e.g., such as that for a rectangular membrane 412 without rounded corners (e.g., capsule-shaped membrane), and other similar arrangements. For instance, for a rectangular membrane 412 with rounded corners, a radial direction can be defined as emanating from the major axes and perpendicular to a tangent line of the curve of the rounded corners, without departing from the disclosed subject matter.

These examples are provided as an illustration that the term, "radial," and associated terms, "nominal center," and so on, should be understood, depending on the context, to encompass arrangements, directions, or configurations in a "radial" arrangement, in a "radial" direction, or in a "radial" configuration, including, but not limited to a conventional understanding of the term, "radius" applicable to a circular shape. As a further example, FIG. 4 further depicts a rectangular membrane 414 with center support structure 416, comprising an upper and lower rectangular membrane flanking the center support structure 416. As described above regarding rectangular membrane 412, the upper and lower segments can be configured with rounded corners or otherwise. Thus, for each of the upper and lower segments of the rectangular membrane 414 flanking the center support structure 416, the term, "radial" can b applied individually to each of upper and lower segments of the rectangular membrane 414 flanking the center support structure 416 as described above regarding rectangular membrane 412

In another non-limiting example, FIG. 4 further depicts an octagonal membrane 418 with center support structure 420. The addition of center support structure 420, adding support in the center can be understood to change the understanding of what is considered a nominal center. For instance, a nominal center can be defined as a circle or polygon (e.g., a polygon corresponding to the membrane or backplate structure shape) about the center support structure 420 located equidistant from the center support structure 420 and the outer edge of the membrane or backplate structure shape. Thus, the term, "radial," can be defined as emanating from this center circle or polygon and perpendicular to a tangent line of a circle that circumscribes octagonal membrane 418.

Of course the examples of the terms, "radial," "nominal center," and so on are provided as an illustration and not limitation of the various described embodiments recited in the claims appended herein. It is understood that it is not possible to describe all possible variations of membrane or backplate structure shape and/or particular configurations of support provided between the outer edges of the membrane or backplate structure shape. Accordingly, the terms, "radial," "nominal center," and so on should be interpreted within the spirit of the various embodiments described herein. For example, various non-limiting embodiments are described herein as comprising membranes or backplates having holes configured with a ratio of a length to a width of greater than one, for example regarding FIGS. 8-10, wherein the length is defined in a first direction that is substantially parallel to a radial direction emanating from a nominal center of the backplate, and wherein the width is defined in a second direction that is substantially parallel to the perimeter of the backplate structure, which can be understood, depending on the context, to be substantially orthogonal to the radial direction and in the plane of the membrane or backplate structure. Note that in the exemplary rectangular membrane 414 with center support structure 416 and octagonal membrane 418 with center support structure 420, the center support structures become an "edge" toward which a "radial" direction can be defined, in further non-limiting aspects.

Figure 5:
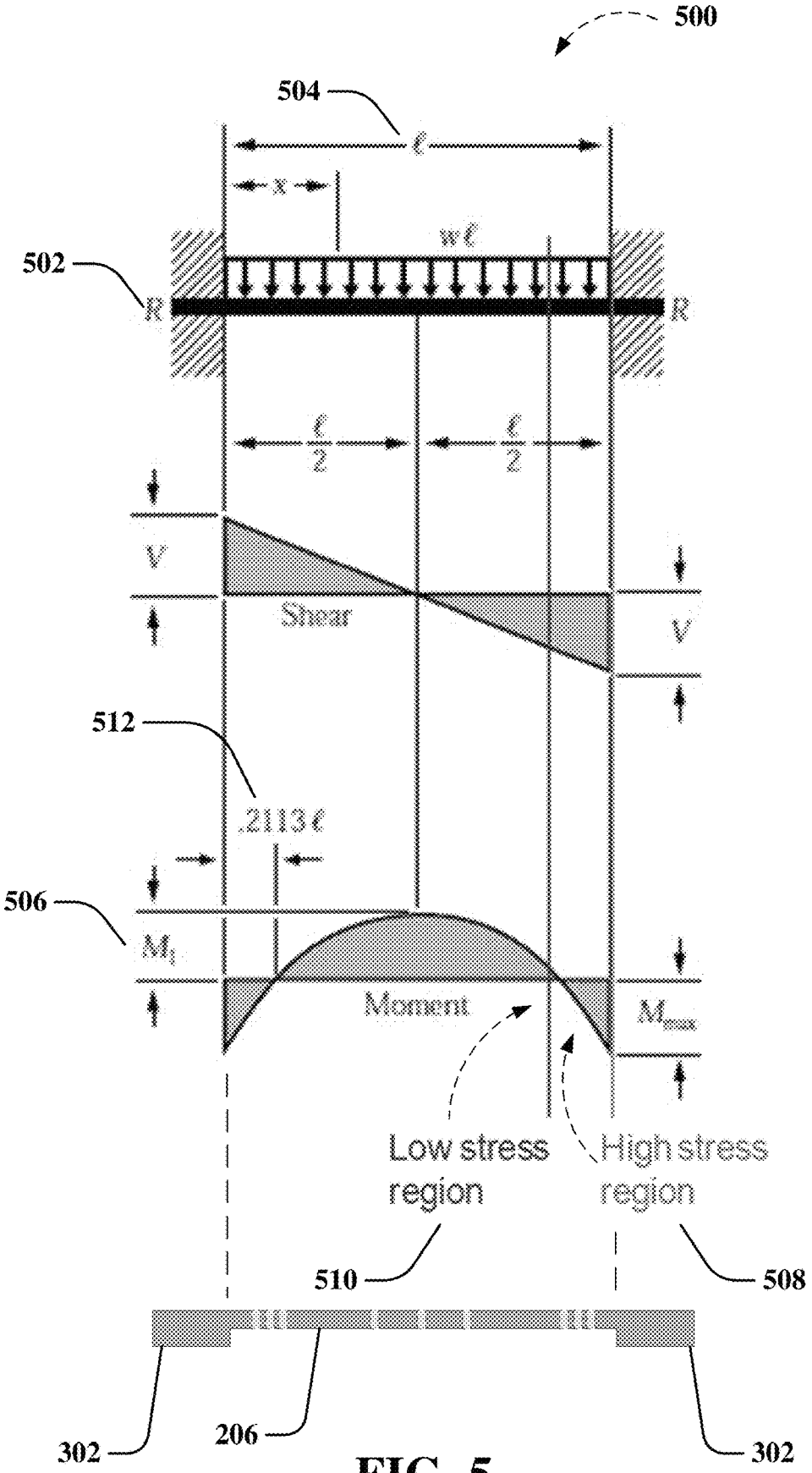
FIG. 5 depicts non-limiting aspects associated with stress loading of an exemplary MEMS acoustic sensor or microphone backplate.

FIG. 5 depicts non-limiting aspects 500 associated with stress loading of a supported beam such as in a MEMS membrane of structure, for example, an exemplary MEMS acoustic sensor or microphone (e.g., microphone or acoustic transducer 100, 200) backplate 206 supported at edges 302. Backplate 206 supported at edges 302 can be modeled by rigid beam 502 having an unsupported length l 504. A force applied to this unsupported length l 504 results in a bending moment 506 and deflection of the unsupported length l 504 of rigid beam 502, which results in a high stress region 508 near the supported edges 302 of rigid beam 502. Due to the flexibility and deflection of the unsupported length l 504 of rigid beam 502, the shear and bending moment decreases across the unsupported length l 504 of rigid beam 502 toward the center (given by l/2) of the unsupported length l 504 of rigid beam 502. Thus, there exists a point 512 along the unsupported length l 504 of rigid beam 502, where the high stress region 508 becomes a low stress region 510. Various non-limiting embodiments described herein can employ disclosed structures and techniques to facilitate reducing maximum stress on the MEMS membrane or backplate structures, as further described herein.

Figure 6:
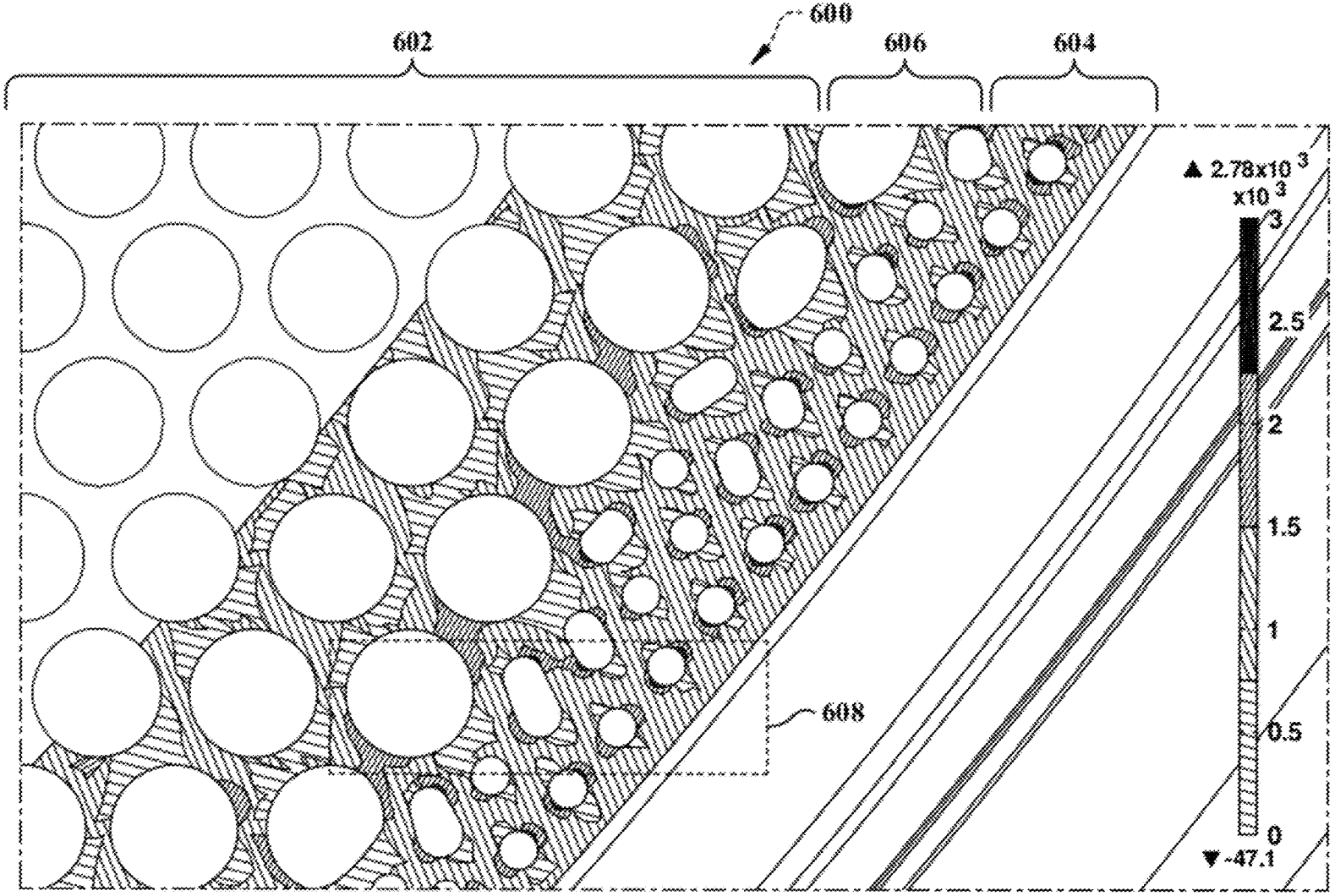
FIG. 6 depicts further non-limiting aspects associated with stress loading of an exemplary configuration of a MEMS acoustic sensor or microphone backplate, as described herein.
Figure 7:
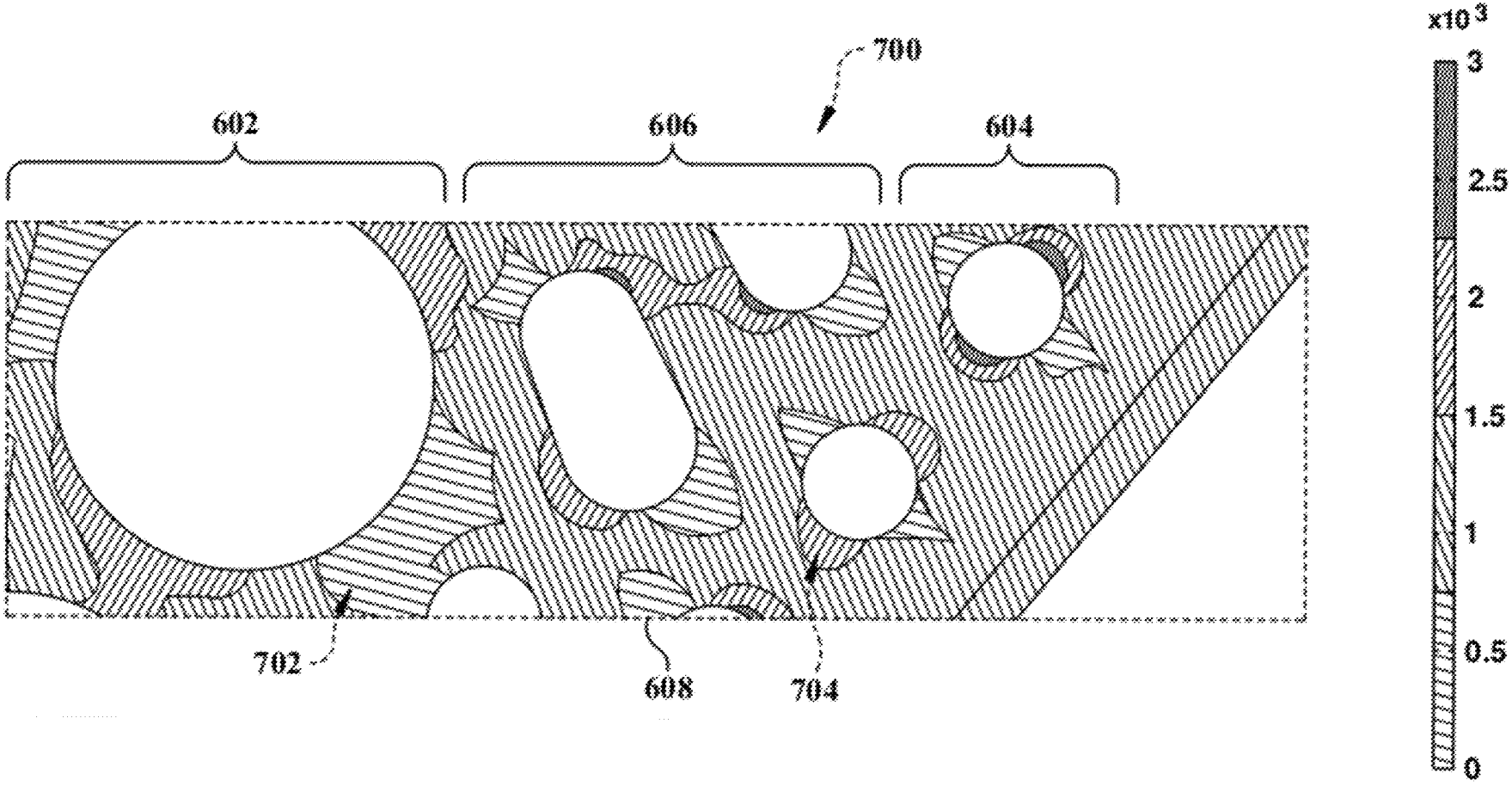
FIG. 7 provides a closer depiction of the stress profile of the exemplary configuration of a MEMS acoustic sensor or microphone backplate in FIG. 6, according to various non-limiting aspects.

For example, FIGS. 6-7 depict stress profiles of an exemplary configuration of a MEMS acoustic sensor or microphone backplate to illustrate the concentration of stress in exemplary MEMS structures. FIG. 6 depicts further non-limiting aspects associated with stress loading of an exemplary configuration of a MEMS acoustic sensor or microphone backplate 600, as described herein. For instance, FIG. 6 illustrates one sector of a generally circular MEMS backplate structure, wherein the MEMS acoustic sensor or microphone backplate 600 has a center region 602, characterized by a uniform sizing and distribution of larger center holes toward a center of the MEMS acoustic sensor or microphone backplate 600, an edge region 604 characterized by a uniform sizing and distribution of smaller edge holes of the MEMS acoustic sensor or microphone backplate 600, and a transition region 606 characterized by irregular sizing and distribution of transition holes between the edge region 604 and the center region 602. FIG. 6 further depicts an inset 608 further described in described in FIG. 7.

FIG. 7 provides a closer depiction of the stress profile of the exemplary configuration of a MEMS acoustic sensor or microphone backplate 600 in FIG. 6, according to various non-limiting aspects. FIG. 7 provides a stress concentration profile in which an area of low stress 702 can be compared with an area of high stress 704. As can be seen in FIGS. 6-7, a typical pattern design of backplate holes in a circular or octangle profile can cause serious stress concentration at the edge of backplate holes, (e.g., in the edge region 604 and the transition region 606). As described above, if a high pressure is applied on the microphone, such as in the case of dropping a mobile phone on a hard, flat surface, the high stress and concentration of stress at the edge of the backplate holes 704 can cause the backplate to break. For instance, during such a drop, e.g., with the sound port opening oriented toward the hard, flat surface, a high pressure can be built up at the MEMS microphone diaphragm membrane. As a result, the MEMS microphone diaphragm membrane can be pressed onto the backplate, causing the backplate to deflect out of plane of the backplate, which can result in a high stress load on the backplate.

Accordingly, various embodiments described herein can significantly reduce the backplate maximum stress with minimal or no substantial changes to manufacturing processes. By providing a more uniform stress distribution at the edge region 604 and/or by moving the transition region 606 holes from a high stress region 508 to a low stress region 510 (e.g., via adding edge pattern holes as described herein), robustness can be improved for MEMS membrane and backplate structures with minimal manufacturing process changes.

Thus, in various non-limiting implementations, disclosed embodiments can add edge pattern holes in the edge region 604, between the transition region 606 and backplate or membrane edge 302, to reduce the maximum stress on the backplate or membrane. As described above regarding FIGS. 6-7, backplate hole of an exemplary MEMS acoustic sensor or microphone backplate 600 can include center holes and transition holes, in which the transition holes can have significant geometry changes to transition from the geometry of the edge holes in the edge region 604 near the backplate edge 302 to the geometry of the center holes in the center region 602. Due to this significant geometry change, the stress concentration causes high stress at the transition holes. According to be on the embodiments, this high stress can be reduced by adding the disclosed edge pattern holes, as further described herein. In another non-limiting aspect, exemplary edge patterns as provided herein can move the transition holes to the low stress region and reduce the stress concentration effect, with minimal process changes.

In further non-limiting aspects, exemplary edge pattern hole shapes can comprise any one of an oval, an egg, an ellipse, a droplet, a cone, or a capsule shape. In still further non-limiting aspects, variations in pattern length, width and spacing can further reduce the stress concentration by creating a more uniform stress distribution. As a result, various non-limiting embodiments described herein comprising the disclosed edge patterns can significantly reduce the stress concentration at the backplate edge.

Figure 8:
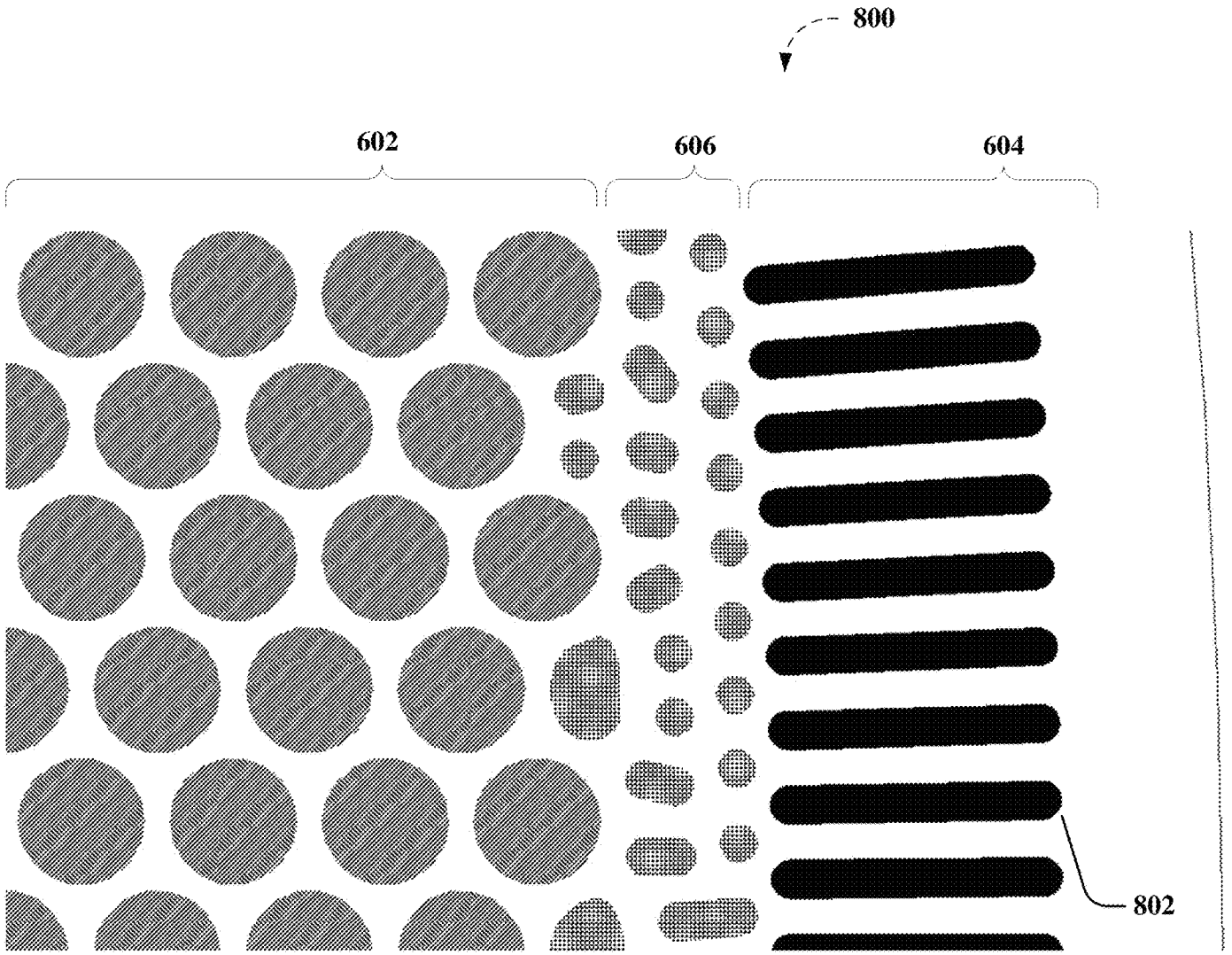
FIG. 8 depicts non-limiting aspects associated with an exemplary MEMS acoustic sensor or microphone backplate as described herein.

For instance, FIG. 8 depicts non-limiting aspects associated with an exemplary MEMS acoustic sensor or microphone backplate 800 as described herein. FIG. 8 illustrates one sector of a generally circular exemplary MEMS backplate structure, wherein the MEMS acoustic sensor or microphone backplate 800 has a center region 602, characterized by a uniform sizing and distribution of larger center holes toward a center of the MEMS acoustic sensor or microphone backplate 800, an edge region 604 characterized by a uniform sizing and distribution of edge pattern holes 802 in a rod-like or capsule-shaped profile for the MEMS acoustic sensor or microphone backplate 800, and a transition region 606 characterized by irregular sizing and distribution of transition holes between the edge region 604 and the center region 602. Note that in comparison to MEMS acoustic sensor or microphone backplate 600, transition region 606 is moved relatively inward toward the center in MEMS acoustic sensor or microphone backplate 800 by the placement of the edge pattern holes in a rod-like or capsule-shaped profile.

Figure 9:
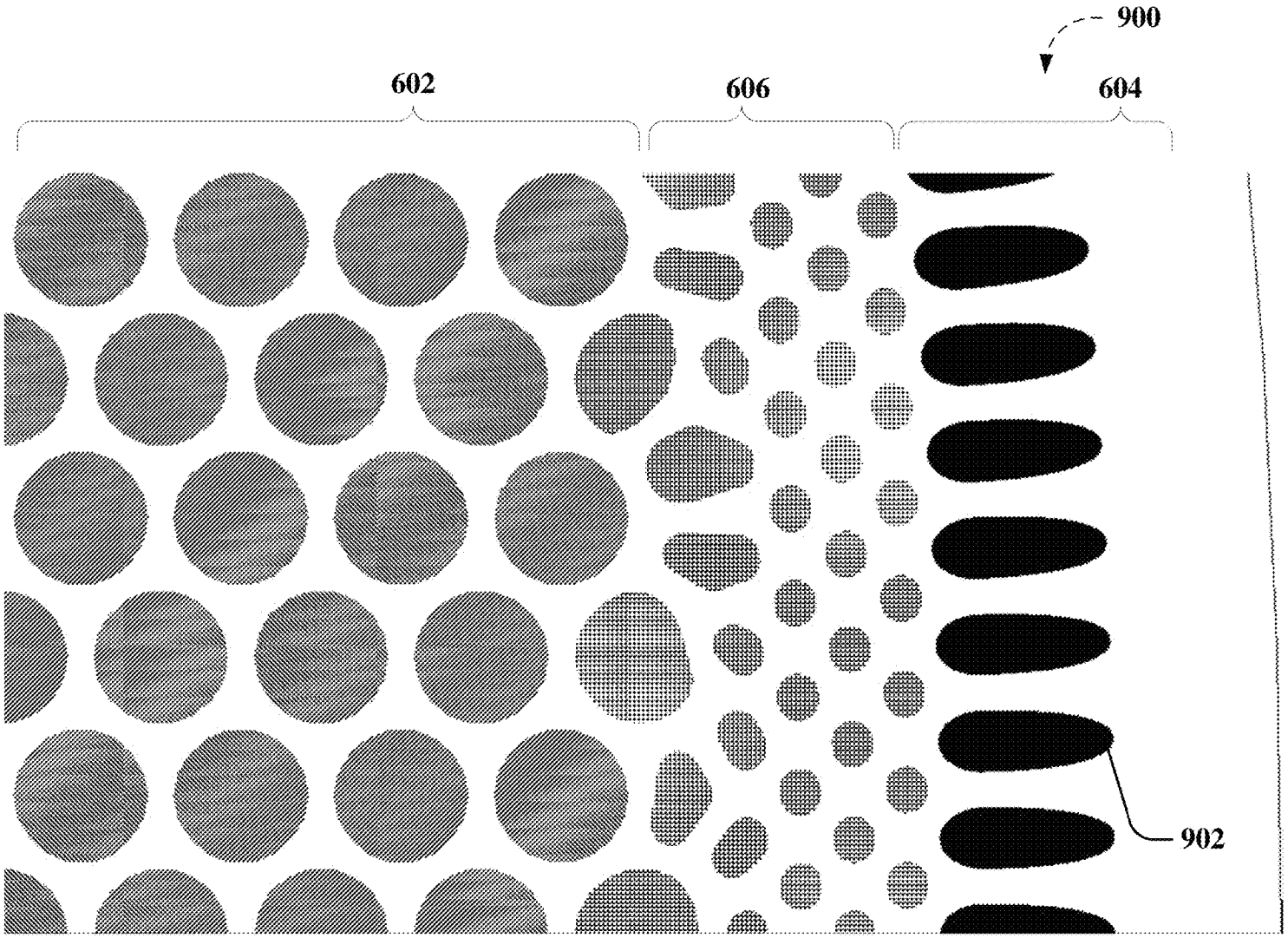
FIG. 9 depicts non-limiting aspects associated with a further exemplary MEMS acoustic sensor or microphone backplate as described herein.

FIG. 9 depicts non-limiting aspects associated with a further exemplary MEMS acoustic sensor or microphone backplate 900 as described herein. FIG. 9 illustrates one sector of a generally circular exemplary MEMS backplate structure, wherein the MEMS acoustic sensor or microphone backplate 900 has a center region 602, characterized by a uniform sizing and distribution of larger center holes toward a center of the MEMS acoustic sensor or microphone backplate 900, an edge region 604 characterized by a uniform sizing and distribution of edge pattern holes 902 in a drop-shaped profile for the MEMS acoustic sensor or microphone backplate 900, and a transition region 606 characterized by irregular sizing and distribution of transition holes between the edge region 604 and the center region 602. Note that in comparison to MEMS acoustic sensor or microphone backplate 600, transition region 606 is moved relatively inward toward the center in MEMS acoustic sensor or microphone backplate 900 by the placement of the edge pattern holes in a rod-like or capsule-shaped profile.

Figure 10:
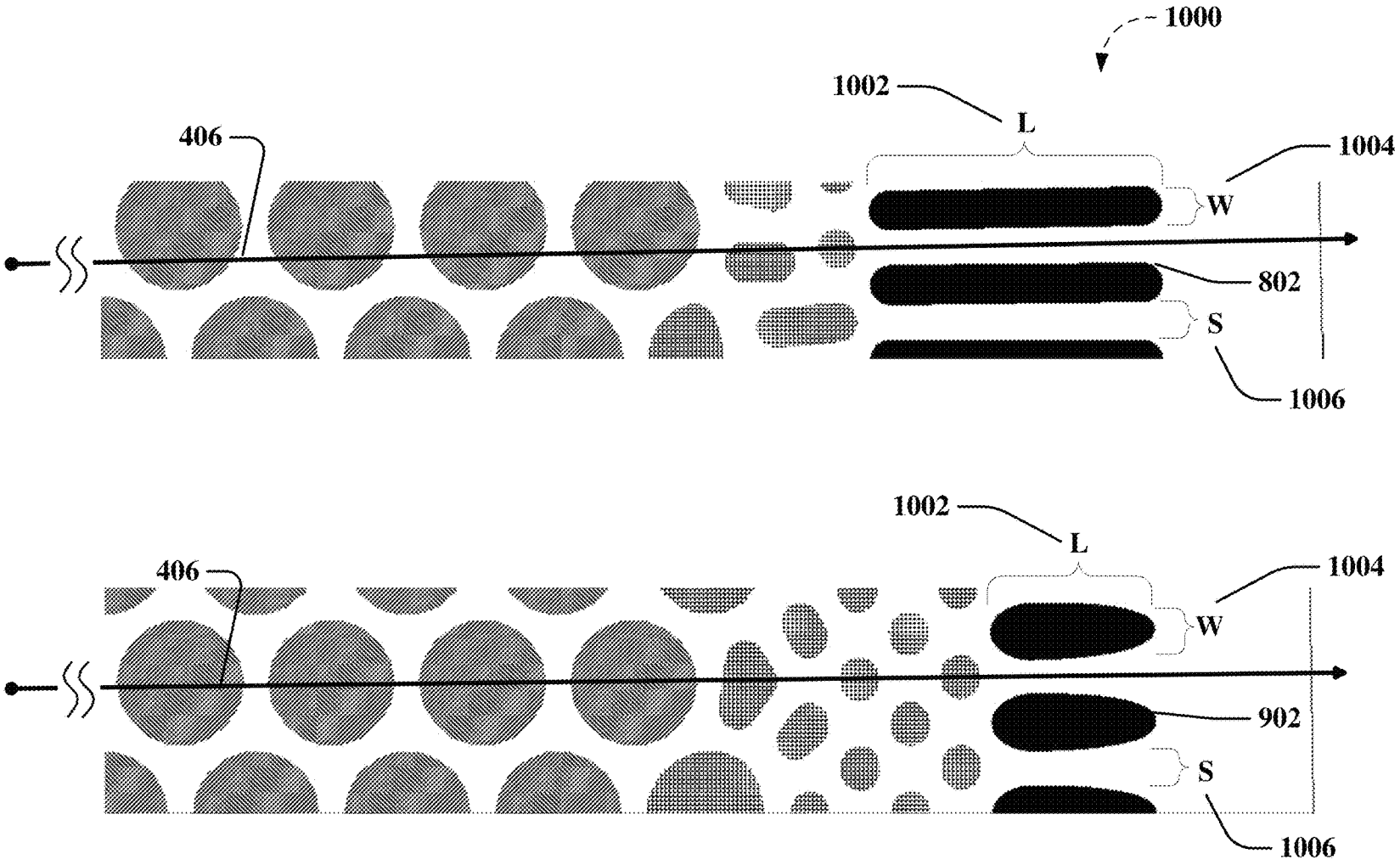
FIG. 10 depicts further non-limiting aspects associated with exemplary MEMS acoustic sensor or microphone backplates as described herein.

FIG. 10 depicts further non-limiting aspects associated with exemplary MEMS acoustic sensor or microphone backplates 800 and 900 as described herein. As described above regarding FIGS. 8-9, addition of the edge pattern holes 802, 902 moves the transition hole from a high stress region 508 to a low stress region 510, in addition, as further described herein regarding FIGS. 11-13, one or more of the uniform sizing, spacing, and shapes of the edge pattern holes 802, 902 can provide more uniform stress distribution at the edge region 604 in addition to further reducing the stress value caused by the stress concentration effect in high stress region 508 by moving the irregular transition holes to the low stress region 510. Aside from potential etching changes required for backplate or membrane release, such improvements are available by incorporating various aspects of the disclosed subject matter, with minimal changes in manufacturing processes.

Accordingly FIG. 10 depicts edge pattern holes 802 in a rod-like or capsule-shaped profile for the MEMS acoustic sensor or microphone backplate 800 and edge pattern holes 902 in a drop-shaped profile for the MEMS acoustic sensor or microphone backplate 800. In addition, FIG. 10 depicts a radius or radial direction 406 emanating from a nominal center of the membrane or backplate shape of the MEMS acoustic sensor or microphone backplate 800 and the MEMS acoustic sensor or microphone backplate 900. According to various non-limiting embodiments as described herein, edge pattern holes 802, 902 can be proximate to the edge 302 and can be configured with a ratio of a length 1002, L, to a width 1004, W, of greater than one, wherein the length 1002, L, is defined in a direction that is substantially parallel to a radius or radial direction 406 emanating from a nominal center of the membrane or backplate shape of the MEMS acoustic sensor or microphone backplate 800, 900, and wherein the width 1004, W, is defined in a second direction that is substantially parallel to the perimeter of the backplate structure, orthogonal to the radius or radial direction 406 emanating from a nominal center of the membrane or backplate shape of the MEMS acoustic sensor or microphone backplate 800, 900, or similarly described, as further described herein regarding various non-limiting MEMS membrane or backplate structure shapes in FIG. 4. Accordingly, various non-limiting embodiments as described herein can employ one or more of the uniform sizing (e.g., length, width), spacing 1006, S, and shapes of the edge pattern holes 802, 902 to facilitate providing more uniform stress distribution at the edge region 604 in addition to further reducing the stress value caused by the stress concentration effect in high stress region 508 by moving the irregular transition holes to the low stress region 510.

In a non-limiting embodiment, the disclosed subject matter provides a MEMS device comprising a MEMS acoustic transducer (e.g., MEMS microphone or acoustic transducer 100, 200). In a non-limiting aspect, exemplary MEMS device can further comprise a backplate structure (e.g., backplate structure 106, 206, 800, 900) of the MEMS acoustic transducer (e.g., MEMS microphone or acoustic transducer 100, 200) that is supported by a portion of the MEMS acoustic transducer (e.g., MEMS microphone or acoustic transducer 100, 200) around an edge (e.g., edge 302) at a perimeter of the backplate structure (e.g., backplate structure 106, 206, 800, 900), wherein the backplate structure (e.g., backplate structure 106, 206, 800, 900) comprises a pattern of backplate holes comprising a first region (e.g., edge region 604) of edge pattern holes (e.g., edge pattern holes 802, 902, and similarly configured edge pattern holes) located proximate the edge (e.g., edge 302) of the backplate structure (e.g., backplate structure 106, 206, 800, 900) and a second region (e.g., transition region 606) comprising transition holes.

In further non-limiting aspects, the pattern of backplate holes is adapted to reduce concentrated stress in the second region (e.g., transition region 606), wherein at least a set of the edge pattern holes (e.g., edge pattern holes 802, 902, and similarly configured edge pattern holes) can be configured with a ratio of a length 1002, L, to a width 1004, W, of greater than one, wherein the length 1002, L, is defined in a direction that is substantially parallel to a radius or radial direction 406 emanating from a nominal center of the backplate structure (e.g., backplate structure 106, 206, 800, 900), and wherein the width 1004, W, is defined in a second direction that is substantially parallel to the perimeter of the backplate structure (e.g., backplate structure 106, 206, 800, 900), orthogonal to the radius or radial direction 406 emanating from a nominal center of the membrane or backplate shape of the MEMS acoustic sensor or microphone backplate 800, 900, or similarly described, as further described herein regarding various non-limiting MEMS membrane or backplate structure shapes in FIG. 4 and as further described herein, regarding FIGS. 8-10.

In a further non-limiting aspect, exemplary edge pattern holes (e.g., edge pattern holes 802, 902, and similarly configured edge pattern holes) can locate the transition holes to the second region (e.g., transition region 606) having lower concentrated stress (e.g., low stress region 510) than in the first region (e.g., edge region 604, high stress region 508) near the edge (e.g., edge 302). In yet another non-limiting aspect, exemplary edge pattern holes (e.g., edge pattern holes 802, 902, and similarly configured edge pattern holes) can be configured to provide uniform stress distribution in the first region (e.g., edge region 604) near the edge (e.g., edge 302). In further non-limiting aspects, the at least the set of edge pattern holes (e.g., edge pattern holes 802, 902, and similarly configured edge pattern holes) can be configured with a profile resembling at least one of an oval, an egg, an ellipse, a droplet 902, a cone, or a capsule 802, as further described herein, regarding FIGS. 8-10.

In still further non-limiting aspect, the at least the set of the edge pattern holes (e.g., edge pattern holes 802, 902, and similarly configured edge pattern holes) can be configured in a radial arrangement, for example, as further described herein regarding FIG. 4. In yet other non-limiting aspects, exemplary transition holes can be located between the edge pattern holes (e.g., edge pattern holes 802, 902, and similarly configured edge pattern holes) and the nominal center of the backplate structure (e.g., backplate structure 106, 206, 800, 900), as further described herein, regarding FIGS. 8-10.

In a further non-limiting embodiment, the disclosed subject matter provides a MEMS device (e.g., MEMS microphone or acoustic transducer 100, 200) that can comprise a backplate structure (e.g., backplate structure 106, 206, 800, 900) of the MEMS device comprising a pattern of backplate holes near an edge (e.g., edge 302) of the backplate structure (e.g., backplate structure 106, 206, 800, 900) and adapted to reduce concentrated stress located near a region (e.g. edge region 604) of the backplate structure (e.g., backplate structure 106, 206, 800, 900) proximate to a perimeter of the backplate structure (e.g., backplate structure 106, 206, 800, 900). In a non-limiting aspect, exemplary MEMS device comprises a MEMS acoustic transducer (e.g., MEMS microphone or acoustic transducer 100, 200).

In a non-limiting aspect, at least a set of the backplate holes comprise edge pattern holes (e.g., edge pattern holes 802, 902, and similarly configured edge pattern holes) proximate to the edge (e.g., edge 302) that can be configured with a ratio of a length 1002, L, to a width 1004, W, of greater than one, wherein the length 1002, L, is defined in a direction that is substantially parallel to a radius or radial direction 406 emanating from a nominal center of the backplate, and wherein the width 1004, W, is defined in a second direction that is substantially parallel to the perimeter of the backplate structure (e.g., backplate structure 106, 206, 800, 900), orthogonal to the radius or radial direction 406 emanating from a nominal center of the membrane or backplate shape of the MEMS acoustic sensor or microphone backplate 800, 900, or similarly described, as further described herein regarding various non-limiting MEMS membrane or backplate structure shapes in FIG. 4 and as further described herein, regarding FIGS. 8-10.

In a non-limiting aspect, exemplary edge pattern holes (e.g., edge pattern holes 802, 902, and similarly configured edge pattern holes) can locate transition holes of the pattern of backplate holes to a second region (e.g., transition region 606) having lower concentrated stress (e.g., low stress region 510) than in the region (e.g., edge region 604, high stress region 508) of the backplate structure (e.g., backplate structure 106, 206, 800, 900) proximate to the perimeter.

In a further non-limiting aspect, exemplary transition holes can be located between the edge pattern holes (e.g., edge pattern holes 802, 902, and similarly configured edge pattern holes) and the nominal center of the backplate structure (e.g., backplate structure 106, 206, 800, 900), for example, as further described herein regarding various non-limiting MEMS membrane or backplate structure shapes in FIG. 4.

In another non-limiting aspect, exemplary edge pattern holes (e.g., edge pattern holes 802, 902, and similarly configured edge pattern holes) can be configured to provide uniform stress distribution in the region (e.g., edge region 604) of the edge pattern holes (e.g., edge pattern holes 802, 902, and similarly configured edge pattern holes).

In yet another non-limiting aspect, at least a set of the backplate holes comprising edge pattern holes (e.g., edge pattern holes 802, 902, and similarly configured edge pattern holes) can be configured with a profile resembling at least one of an oval, an egg, an ellipse, a droplet 902, a cone, or a capsule 802, as further described herein, regarding FIGS. 8-10.

In a non-limiting aspect, the at least the set of the backplate holes comprising edge pattern holes (e.g., edge pattern holes 802, 902, and similarly configured edge pattern holes) can be configured in a radial arrangement, for example, as further described herein regarding FIG. 4 and as further described herein, regarding FIGS. 8-10. In a non-limiting aspect, exemplary backplate structure (e.g., backplate structure 106, 206, 800, 900) can be supported by a portion of the MEMS acoustic transducer around the edge (e.g., edge 302) at the perimeter of the backplate structure (e.g., backplate structure 106, 206, 800, 900).

As described herein, various non-limiting embodiments are described herein with reference to exemplary backplate structure (e.g., backplate structure 106, 206, 800, 900) of an exemplary MEMS device (e.g., MEMS microphone or acoustic transducer 100, 200). However, as further described herein, various disclosed aspects can be employed in any MEMS membrane structure (e.g., edge-supported MEMS membranes) to achieve robust MEMS devices.

Accordingly, in yet another non-limiting embodiment, the disclosed subject matter provides a MEMS device (e.g., MEMS sensor, MEMS microphone or acoustic transducer 100, 200) comprising a membrane structure of the MEMS device comprising an edge (e.g., edge 302) of the membrane structure, a support structure adjacent to and in contact with the edge (e.g., edge 302) of the membrane structure, and a pattern of holes near the edge (e.g., edge 302) of the membrane structure comprising edge pattern holes (e.g., edge pattern holes 802, 902, and similarly configured edge pattern holes) that are configured with a ratio of a length 1002, L, to a width 1004, W, of greater than one, wherein the length 1002, L, is defined in a direction that is substantially parallel to a radius or radial direction 406 emanating from a nominal center of the membrane structure, and wherein the width 1004, W, is defined in a second direction that is substantially parallel to the perimeter of the membrane structure, orthogonal to the radius or radial direction 406 emanating from a nominal center of the membrane structure of the MEMS sensor or device, or similarly described, as further described herein regarding various non-limiting MEMS membrane or backplate structure shapes in FIG. 4 and as further described herein, regarding FIGS. 8-10.

In a non-limiting aspect, exemplary MEMS device (e.g., MEMS sensor, MEMS microphone or acoustic transducer 100, 200) can further transition holes in the membrane structure located between the edge pattern holes (e.g., edge pattern holes 802, 902, and similarly configured edge pattern holes) and the nominal center of the membrane structure, as further described herein regarding various non-limiting MEMS membrane or backplate structure shapes in FIG. 4 and as further described herein, regarding FIGS. 8-10.

In another non-limiting aspect, exemplary edge pattern holes (e.g., edge pattern holes 802, 902, and similarly configured edge pattern holes) can locate the transition holes in a region (e.g., transition region 606) of having low concentrated stress (e.g., low stress region 510) relative to concentrated stress (e.g., high stress region 510) of the membrane structure near the edge (e.g., edge 302).

In yet another non-limiting aspect, at least a set of the edge pattern holes (e.g., edge pattern holes 802, 902, and similarly configured edge pattern holes) can be configured with at least one of a uniform size or a uniform spacing adapted to provide uniform stress distribution near the edge (e.g., edge 302).

In further non-limiting aspects, the at least a set of the edge pattern holes (e.g., edge pattern holes 802, 902, and similarly configured edge pattern holes) can be configured with a profile resembling at least one of an oval, an egg, an ellipse, a droplet 902, a cone, or a capsule 802. In still further non-limiting aspects, exemplary membrane structures can comprises a backplate structure (e.g., backplate structure 106, 206, 800, 900) of a MEMS acoustic transducer (e.g., MEMS microphone or acoustic transducer 100, 200).

Figure 11:
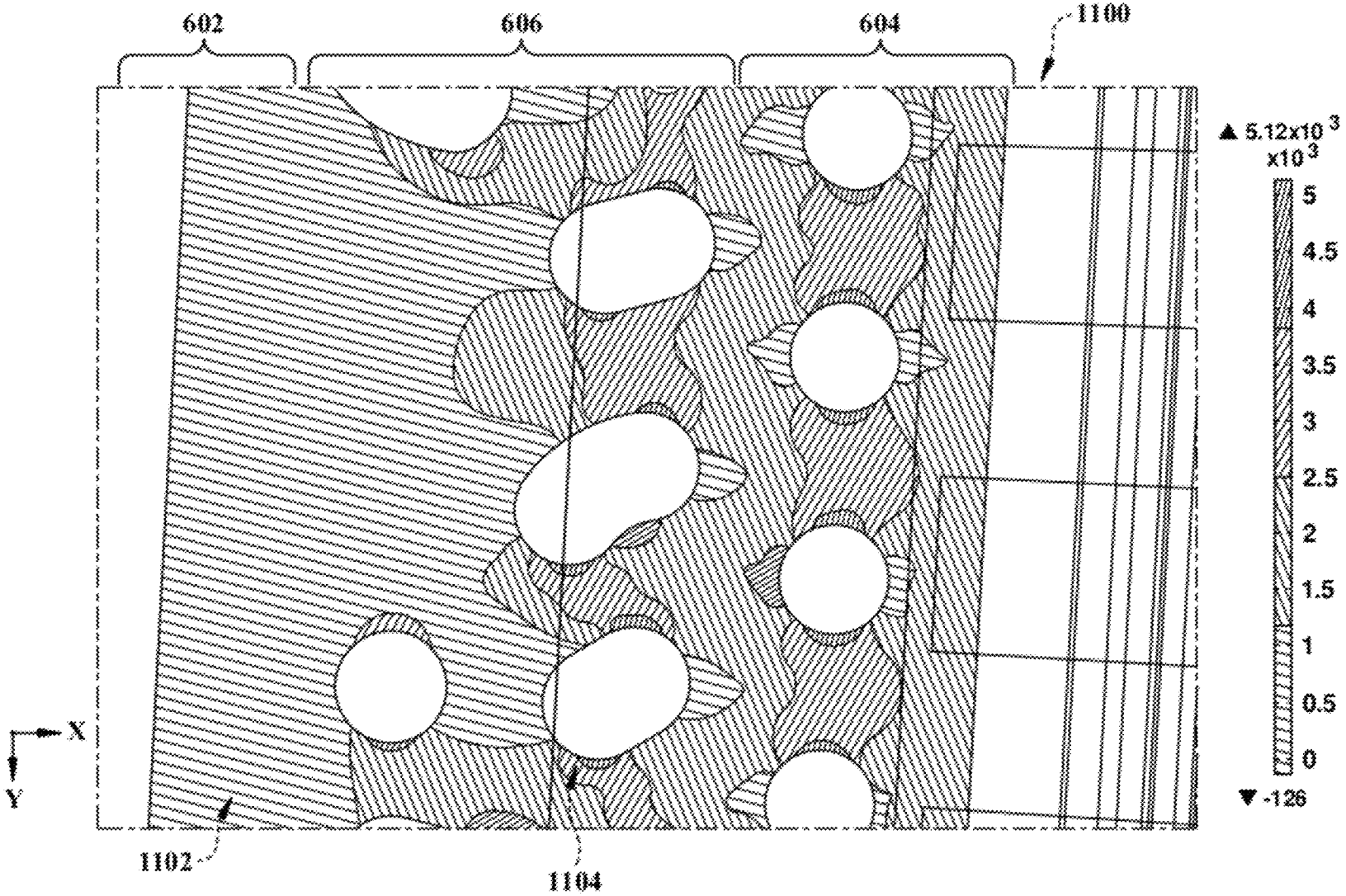
FIG. 11 depicts non-limiting aspects associated with stress loading of an exemplary MEMS acoustic sensor or microphone backplate as depicted in FIGS. 6-7.

FIG. 11 depicts non-limiting aspects associated with stress loading of an exemplary MEMS acoustic sensor or microphone backplate as depicted in FIGS. 6-7. For instance, FIG. 11 depicts stress loading profile 1100 of the exemplary MEMS acoustic sensor or microphone backplate as depicted in FIGS. 6-7, showing regions 1102 of relatively low, uniform stress in the transition region 606 and center region 602 and regions 1104 of relatively high, concentrated stress in the edge region 604 and transition region 606.

Figure 12:
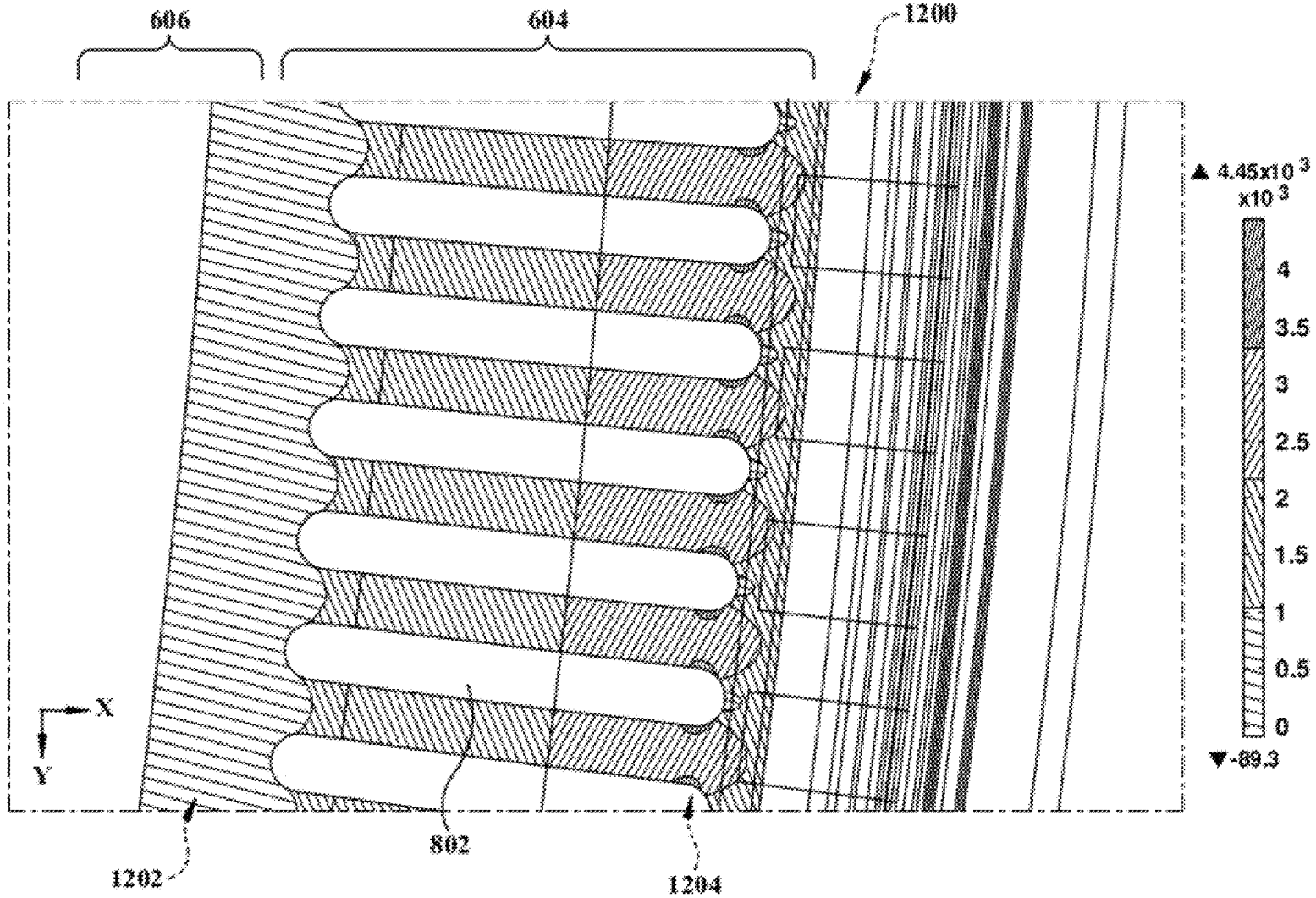
FIG. 12 depicts non-limiting aspects associated with stress loading of an exemplary MEMS acoustic sensor or microphone backplate as depicted in FIG. 8.

As can be seen in FIGS. 11-12, various embodiments described herein employing edge pattern holes (e.g., edge pattern holes 802, 902, and similarly configured edge pattern holes) can provide dramatic reductions of stress in these regions. For instance, FIG. 12 depicts non-limiting aspects associated with stress loading of an exemplary MEMS acoustic sensor or microphone backplate as depicted in FIG. 8. FIG. 12 depicts stress loading profile 1200 of the exemplary MEMS acoustic sensor or microphone backplate as depicted in FIGS. 8 and 10, showing regions 1202 of relatively low, uniform stress in the transition region 606 and regions 1204 of relatively high, concentrated stress only in the edge region 604. As can be seen, by employing edge pattern holes 802 in a rod-like or capsule-shaped profile a maximum stress reduction of approximately 17 percent (%) can be obtained over the configuration of the exemplary MEMS acoustic sensor or microphone backplate as depicted in FIGS. 6-7 and 11.

Figure 13:
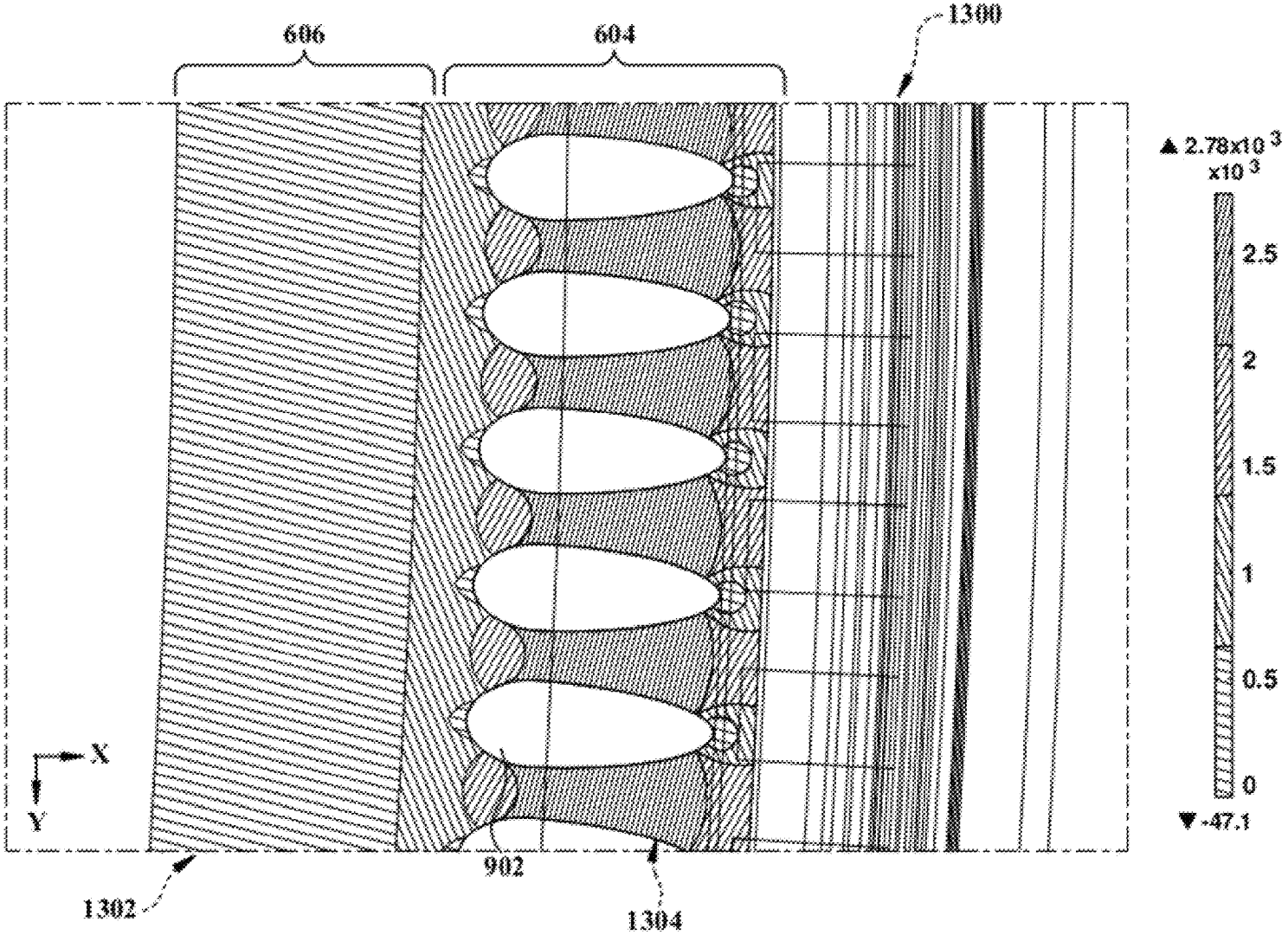
FIG. 13 depicts non-limiting aspects associated with stress loading of an exemplary MEMS acoustic sensor or microphone backplate as depicted in FIG. 9.

FIG. 13 depicts non-limiting aspects associated with stress loading of an exemplary MEMS acoustic sensor or microphone backplate as depicted in FIG. 9. FIG. 13 depicts stress loading profile 1300 of the exemplary MEMS acoustic sensor or microphone backplate as depicted in FIGS. 9-10, showing regions 1302 of relatively low, uniform stress in the transition region 606 and regions 1304 of relatively high, concentrated stress only in the edge region 604. As can be seen, by employing edge pattern holes 902 in a drop-shaped profile a maximum stress reduction of approximately 49% can be obtained over the configuration of the exemplary MEMS acoustic sensor or microphone backplate as depicted in FIGS. 6-7 and 11, and a maximum stress reduction of approximately 38% can be obtained over the configuration of the exemplary MEMS acoustic sensor or microphone backplate as depicted in FIGS. 8, 10, and 12.

As described herein, such stress reduction in exemplary MEMS membrane or backplate structures can be achieved merely with layout changes and etching process changes, which can be employed by one having skill in the art. Thus, in view of the subject matter described supra, methods that can be implemented in accordance with the disclosed subject matter can be appreciated. Thus, exemplary methods provided herein can include methods of manufacturing the MEMS membranes and backplate structures and devices associated therewith, as further described herein.

What has been described above includes examples of the embodiments of the disclosed subject matter. It is, of course, not possible to describe every conceivable combination of configurations, components, and/or methods for purposes of describing the claimed subject matter, but it is to be appreciated that many further combinations and permutations of the various embodiments are possible. Accordingly, the claimed subject matter is intended to embrace all such alterations, modifications, and variations that fall within the spirit and scope of the appended claims. While specific embodiments and examples are described in disclosed subject matter for illustrative purposes, various modifications are possible that are considered within the scope of such embodiments and examples, as those skilled in the relevant art can recognize.

In addition, the words "example" or "exemplary" is used herein to mean serving as an example, instance, or illustration. Any aspect or design described herein as "exemplary" is not necessarily to be construed as preferred or advantageous over other aspects or designs. Rather, use of the word, "exemplary," is intended to present concepts in a concrete fashion. As used in this application, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

In addition, while an aspect may have been disclosed with respect to only one of several embodiments, such feature may be combined with one or more other features of the other embodiments as may be desired and advantageous for any given or particular application. Furthermore, to the extent that the terms "includes," "including," "has," "contains," variants thereof, and other similar words are used in either the detailed description or the claims, these terms are intended to be inclusive in a manner similar to the term "comprising" as an open transition word without precluding any additional or other elements. Numerical data, such as voltages, ratios, and the like, are presented herein in a range format. The range format is used merely for convenience and brevity. The range format is meant to be interpreted flexibly to include not only the numerical values explicitly recited as the limits of the range, but also to include all the individual numerical values or sub-ranges encompassed within the range as if each numerical value and sub-range is explicitly recited. When reported herein, any numerical values are meant to implicitly include the term "about." Values resulting from experimental error that can occur when taking measurements are meant to be included in the numerical values.

What is claimed is:

1. A microelectromechanical systems (MEMS) device, comprising:

a MEMS acoustic transducer; and a backplate structure of the MEMS acoustic transducer that is supported by a portion of the MEMS acoustic transducer around an edge at a perimeter of the backplate structure, wherein the backplate structure comprises a pattern of backplate holes comprising a first region of edge pattern holes located proximate the edge of the backplate structure and a second region comprising transition holes, wherein the edge pattern holes are configured to provide uniform stress distribution in the first region, wherein the pattern of backplate holes is adapted to reduce concentrated stress in the second region, wherein at least a set of the edge pattern holes are configured with a ratio of a length to a width of greater than one, wherein the length is defined in a first direction that is substantially parallel to a radial direction emanating from a nominal center of the backplate structure, and wherein the width is defined in a second direction that is substantially parallel to the perimeter of the backplate structure.

2. The MEMS device of claim 1, wherein the edge pattern holes are configured to position the transition holes to the second region having lower concentrated stress than in the first region near the edge.

3. The MEMS device of claim 1, wherein the at least the set of edge pattern holes are configured with a profile resembling at least one of an oval, an egg, an ellipse, a droplet, a cone, or a capsule.

4. The MEMS device of claim 1, wherein the at least the set of the edge pattern holes are configured in a radial arrangement.

5. The MEMS device of claim 1, wherein the transition holes are located between the edge pattern holes and the nominal center of the backplate structure.

6. A microelectromechanical systems (MEMS) device, comprising:

a backplate structure of the MEMS device comprising a pattern of backplate holes near an edge of the backplate structure and adapted to reduce concentrated stress located near a region of the backplate structure proximate to a perimeter of the backplate structure, wherein at least a set of the backplate holes comprise edge pattern holes proximate to the edge and configured with a ratio of a length to a width of greater than one, wherein the edge pattern holes are configured to provide uniform stress distribution in the region of the edge pattern holes, wherein the length is defined in a first direction that is substantially parallel to a radial direction emanating from a nominal center of the backplate, and wherein the width is defined in a second direction that is substantially parallel to the perimeter of the backplate structure.

7. The MEMS device of claim 6, wherein the edge pattern holes locate transition holes of the pattern of backplate holes to a second region having lower concentrated stress than in the region of the backplate structure proximate to the perimeter.

8. The MEMS device of claim 7, wherein the transition holes are located between the edge pattern holes and the nominal center of the backplate structure.

9. The MEMS device of claim 6, wherein the at least a set of the backplate holes comprising edge pattern holes are configured with a profile resembling at least one of an oval, an egg, an ellipse, a droplet, a cone, or a capsule.

10. The MEMS device of claim 6, wherein the at least the set of the backplate holes comprising edge pattern holes are configured in a radial arrangement.

11. The MEMS device of claim 6, wherein the MEMS device comprises a MEMS acoustic transducer.

12. A microelectromechanical systems (MEMS) device, comprising:

a membrane structure of the MEMS device comprising an edge of the membrane structure;

a support structure adjacent to and in contact with the edge of the membrane structure; and a pattern of holes near the edge of the membrane structure comprising edge pattern holes that are configured with a ratio of a length to a width of greater than one, wherein at least a set of the edge pattern holes are configured with at least one of a uniform size or a uniform spacing adapted to provide uniform stress distribution near the edge, wherein the length is defined in a first direction that is substantially parallel to a radial direction emanating from a nominal center of the membrane structure, and wherein the width is defined in a second direction that is substantially parallel to the perimeter of the membrane structure.

13. The MEMS device of claim 12, further comprising:

transition holes in the membrane structure located between the edge pattern holes and the nominal center of the membrane structure.

14. The MEMS device of claim 12, wherein the edge pattern holes locate the transition holes in a region of having low concentrated stress relative to concentrated stress of the membrane structure near the edge.

15. The MEMS device of claim 12, wherein the at least a set of the edge pattern holes are configured with a profile resembling at least one of an oval, an egg, an ellipse, a droplet, a cone, or a capsule.

16. The MEMS device of claim 12, wherein the membrane structure comprises a backplate structure of a MEMS acoustic transducer.

* * * * *